United States Patent [19]

Radice

[11] Patent Number: 4,815,345

[45] Date of Patent: Mar. 28, 1989

[54] PORTABLE HYDRANT WRENCH

[76] Inventor: Robert Radice, 4005 Brookhaven Club Dr., Dallas, Tex. 75244

[21] Appl. No.: 40,170

[22] Filed: Apr. 20, 1987

Related U.S. Application Data

[63] Continuation-in-part of Ser. No. 875,068, Jun. 17, 1986, abandoned.

[51] Int. Cl.[4] ..... B25B 21/00

[52] U.S. Cl. ..... 81/57.3; 81/44

[58] Field of Search ..... 81/57.3, 44

[56] References Cited

U.S. PATENT DOCUMENTS

| | | | |
|---|---|---|---|
| 3,768,775 | 10/1973 | Archer | 251/291 |
| 4,027,561 | 6/1977 | Junkers | 81/57.39 |
| 4,178,816 | 12/1979 | Radice | 81/57.3 |
| 4,398,598 | 8/1983 | Fabrygel | 81/57.39 |

*Primary Examiner*—Frederick R. Schmidt
*Assistant Examiner*—Maurina Rachuba
*Attorney, Agent, or Firm*—Stanley Ira Laughlin

[57] ABSTRACT

A portable hydrant wrench for use by one man comprising one or more drive bars having a rectangular cross-section and employing a detachable socket wrench at one of the free ends. A flange is secured to the hydrant to be serviced provided in conjunction with the hydrant for one embodiment of the invention having an external rotatable support for a platform for positioning the drive bars in the center of the hydrant so that a turning device can be used to turn the tool with out providing any twisting force to the hydrant. Another embodiment of the invention provides for an internal platform within the hydrant for supporting internal power transmitting means to turn the drive bars and so operate, remove or replace the valves located underground.

11 Claims, 5 Drawing Sheets

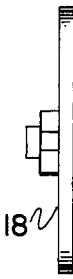
Fig. 2b
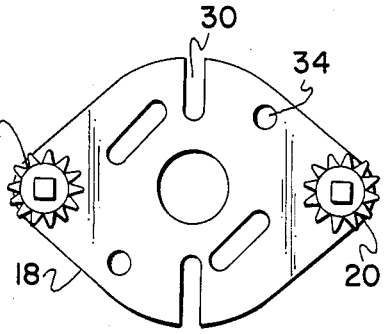
Fig. 2a
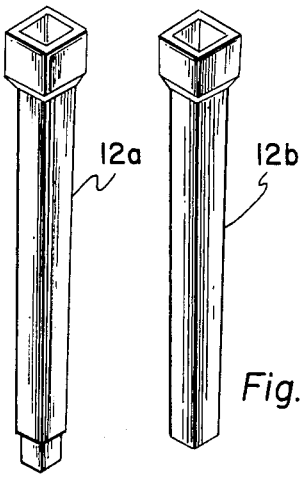
Fig. 4b
Fig. 4a
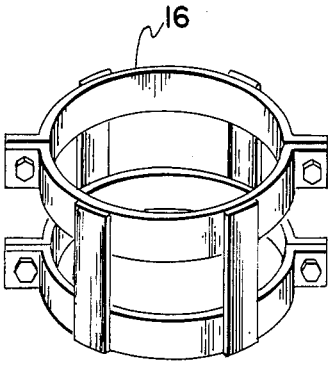
Fig. 3
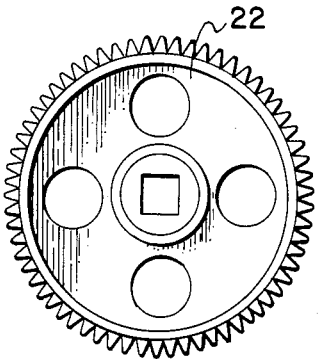
Fig. 5

PORTABLE HYDRANT WRENCH

BACKGROUND OF THE INVENTION

This application is a continuation-in-part of Ser. No. 06/875,068, filed June 17, 1986, which application is expressly abandoned subsequent to the filing date of this application.

The invention relates to hydrant tools and more particularly to valve actuators for use with valves buried underground such as taught in Class 251 subclasses 230, 291, 292 & 293 and Class 81 subclasses 56, 57, 58, 71 & 72.

Smeaton U.S. Pat. No. 169,489 describes a tool for turning stop cocks which comprises a pair of prongs for turning the plug without resting the weight of the tool upon the stop cock.

O'Brien U.S. Pat. No. 694,298 describes the basic extension tool for removing and replacing main hydrant valves.

Block U.S. Pat. No. 1,181,565 describes a tool employing a cylindrical rod having a keyway at one end for reaching buried shut-off valves.

Hurley U.S. Pat. No. 1,493,983 describes telescoping extension members employing pins to prevent rotation of the telescoping members within each other so that a wrench may be used to turn a nut at a location where it is impossible to use the wrench alone.

Green U.S. Pat. No. 1,806,556 describes a tool employing a plurality of tubes, one fitting within the other, and employing expandible jaws mounted at the bottom of the extended tube for expansion within the pipe to be turned; thereby grasping the pipe so that it may be turned with the tool Armstrong U.S. Pat. No. 1,815,755 describes apparatus for lubricating underground valves by employing a cylinder having a piston operated from the upper handle similar to a grease gun.

Downer U.S. Pat. No. 1,885,593 describes a tool for replacing faucet valves under pressure.

Gifford U.S. Pat. No. 2,088,785 describes a tool employing a yoke having eccentric gripping jaws which may be turned to grip the inside of the pipe to be turned.

Scillia U.S. Pat. No. 2,116,770 to describes internal means within a hydrant for supporting the wrench.

Cox U.S. Pat. No. 2,895,363 describes a tool for safely removing vehicle radiator caps from a distance; the tool providing a mating head cut-out for the radiator cap and a handle substantially orthogonal fastened to the head.

Sergan U.S. Pat. No. 2,961,904 describes hydraulic wrenches.

Archer U.S. Pat. No. 3,768,775 to describes a portable valve actuator which employs a yoke that is placed over the valve and engages the sides of the valve to enable the application of high torques to the valve and not the pipe.

Junkers U.S. Pat. No. 4,027,561 describes hydraulically operated wrenches.

Latham U.S. Pat. No. 4,086,830 describes a hand tool employing hydraulic rams to provide torque.

Jurgens et al U.S. Pat. No. 4,092,881 describes apparatus that uses hydraulic means to break open a threaded connection.

U.S. Pat. No. 4,178,816 to applicant, Robert Radice, describes a portable hydrant wrench comprising a plurality of extendible drie bars employing a detachable socket at one of its free ends and a platform, secured to the hydrant to be serviced for positioning of the drive bars. The free end of the drive bars opposite the end employing the detachable socket is rotated by a gear assembly.

Costes U.S. Pat. No. 4,186,629 describes a ring gear mounted on the outer surface of the nut and gear pinion in mesh with the crown, which pinion is rotatably mounted on a fixed pin and has a cavity for receiving a device for driving the pinion in rotation.

Fabrygel U.S. Pat. No. 4,398,598 teaches an annular frame that is mounted over a threaded head that receives torque from hydraulic jacks mounted on the frame.

Chilton U.S. Pat. No. 4,630,347 describes a hydrant tool identical to the tool of U.S. Pat. No. 4,187,816; differing only in the employment of hydraulic means in place of the gear apparatus.

Applicant's invention is an improvement of his patented tool employing a rotatable flange and/or hydraulic means to operate a plurality of tools to rotate the hydrant wrench.

It is an object of applicant's invention to provide a safe, simple and economical tool for operating and replacing underground hydrant main valves.

It is a further object of applicant's invention to provide a lightweight tool for operating and replacing underground hydrant main valves by only one workman.

It is yet a further object of applicant's invention to provide a tool for operating and replacing underground hydrant main valves that is easy to assemble and operate.

SUMMARY OF THE INVENTION

The invention relates to an improvement in lightweight, disassembled portable hydrant wrench for operation and removal by a single workman. One or more conventional rectangular or circular drive bars provide the means for extending the interchangeable socket head that can be readily detached for mating with different types of valves. A rotatable flange, encircling the hydrant at the hydrant opening and/or power transmitting means such as employed in hydraulic devices positioned internally within the hydrant system to rotate the drive bars and socket head of the hydrant wrench.

BRIEF DESCRIPTION OF THE DRAWING

Applicant's invention will be more clearly understood by reading the Detailed Description in conjunction to the following drawings wherein:

FIGS. 2*a* and 2*b* are plan and side elevation drawings of the elliptical base plate with gears for the hydrant wrench shown in FIG. 1.

FIG. 3 shows an isometric view of the hydrant flange shown in FIG. 1.

FIG. 4 are isometric views of the detachable drive bars shown in FIG. 1.

FIG. 5 is a top plan view of the gear assembly driven by the gears positioned upon the base plate shown in FIGS. 1, 2*a* and 2*b*.

DETAILED DESCRIPTION

Figure 1:
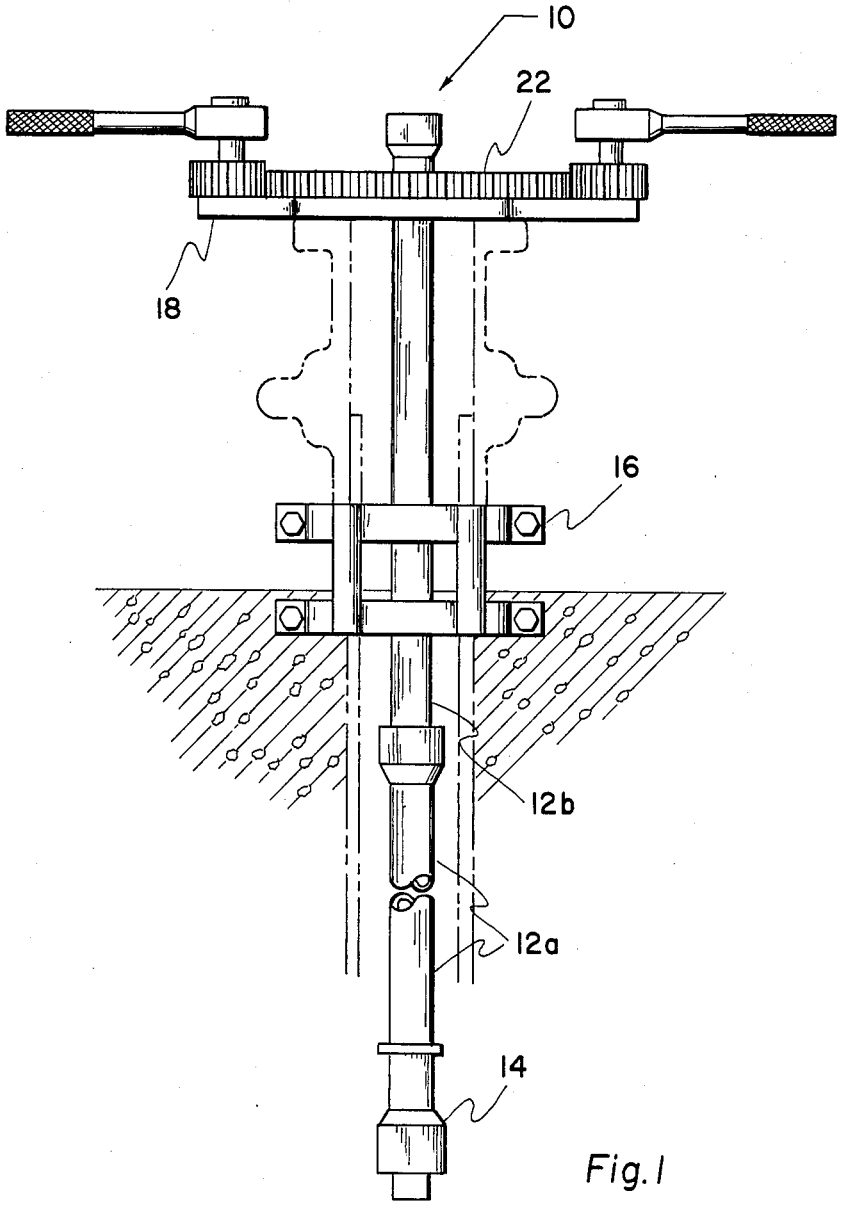
FIG. 1 is a side elevation drawing of one embodiment of the hydrant wrench assembled and in operating position.

FIG. 1 shows an embodiment of applicant's improved hydrant wrench 10 in operating position in a hydrant shown in outline, comprising a plurality of rectangular cross-section drive bars 12*a* and 12*b*, a detachable socket head 14 connected with the drive bar and interchangeable with other heads mating with a particular valve seated in the underground portion of the hydrant to be serviced, an elliptical base plate 18 positioned upon the upper flange of the hydrant to provide a platform for positioning, inter alia, the rectangular drive bars 12*a* & 12*b* at free ends opposite those free ends having detachable socket head connected thereto as well as the gear assemblies 20 & 22; shown more clearly in FIGS. 2*a* & 2*b* and FIG. 5, respectively, for driving drive bars 12*a* & 12*b*. A hydrant flange 16 encircling the hydrant at the maximum torque stress location of the hydrant which is usually in the vicinity of the hydrant and the ground to prevent the hydrant from turning when large torque are applied. FIG. 3 shows an embodiment of hydrant flange 16. FIG. 4 shows drive bars 12*a* & 12*b*.

Operation of this wrench which is transported to the hydrant work site in a disassembled condition commences with the assembling of the wrench by a single workman. An many drive bars as are required by the job are positioned within the hydrant to be serviced; having first attached the proper socket head before connecting up the drive bars. The flange is fastened at the base of the hydrant. The elliptical base plate, supported upon the hydrant opening is positioned so as to center the drive bar. Finally, gear 22 is positioned between the gear assemblies 20 on the elliptical base plate 18 and the entire wrench assembly 10 is operated by the rotating socket wrenches.

Figure 6:
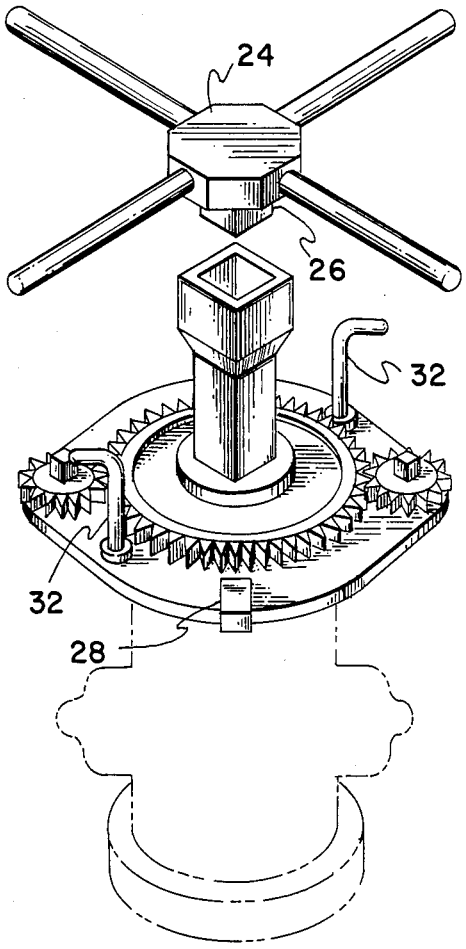
FIG. 6 is an plan view drawing of another embodiment of a portion of the hydrant wrench shown in FIG. 1.
Figure 7A:
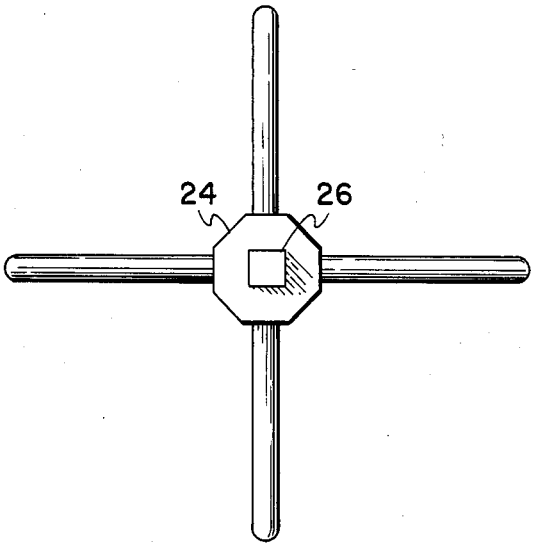
FIGS. 7 *a*) & (*b*) are plan and elevation drawings respectively of a modified turning device.
Figure 7B:
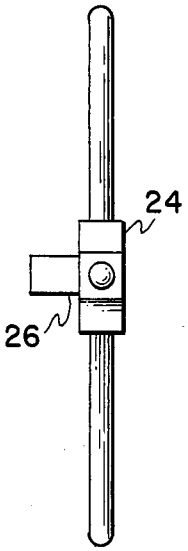
Figure 8:
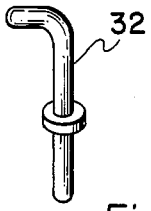
FIG. 8 shows in detail one of the stabilizing pins shown in FIG. 6.
Figure 9:
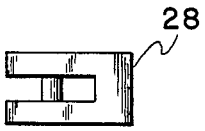
FIG. 9 shows in detail one of the guides shown in FIG. 6.

Should the job not require a large torque force, a turning device 24 shown only for illustration as a manual wrench and having an extension 26 as shown in FIGS. 6, 7*a*) and 7(*b*) can be employed along with guides 28 shown in FIG. 9 positioned in slots 30 of the elliptical base plate 18 and stabilizing pins 32 shown in FIG. 8 placed into aperatures 34 of the elliptical base plate 18 to enable the turning of socket head 14. When turning device 24 is rotated clockwise to manually or otherwise turn the tool, gear 22 and elliptical base plate 18 are rotated clockwise while maintaining the drive bars in the center of the hydrant without allowing any large twisting force to impact upon the hydrant.

Figure 10:
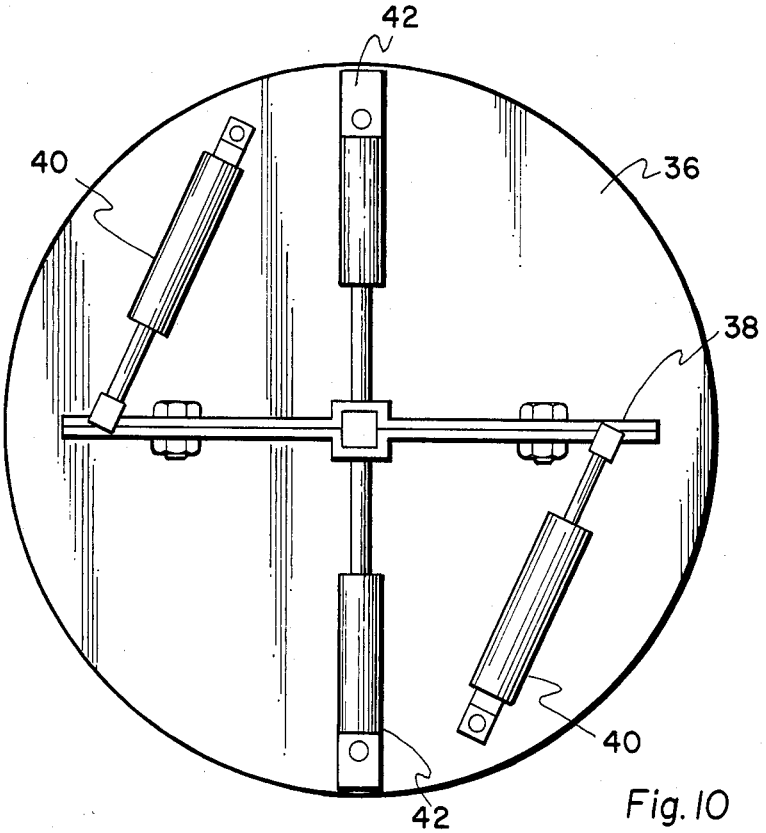
FIG. 10 is a plan view of yet another embodiment of the improved hydrant wrench.
Figure 11:
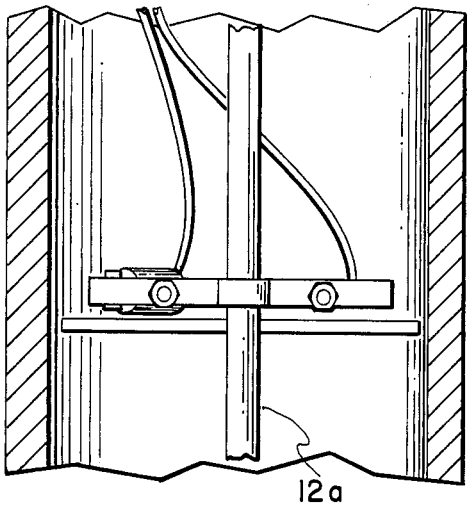
FIG. 11 is a side elevation drawing of an underground portion of a hydrant system employing the embodiment of the hydrant wrench shown in FIG. 10.

Should the job require a torque larger than that which can be obtained by the gear assembly, the apparatus shown in FIGS. 10 and 11 relates to externally activated power means within said hydrant for rotating said drive bars with sufficient torque comprises supporting means for the fixed placement of said power means such as a platform or other structure 36 having spring loaded telescopic devices 42 employed for positioning internally within the hydrant by pushing against the inside walls of the hydrant system and clamped by clamps 38 to drive bars 12*a* or 12*b*. Hydraulic or pneumatic jacks 40 activated by pumps outside of the hydrant are positioned upon said platform or other structure 36 to move said clamping means 38 when activated and thereby turn socket 14 resulting in the operation, removal or installation of the main valve or other equipment of the hydrant. Extendable spokes, rims or other support structure that can be utilize to position the hydraulic or pneumatic devices internally within the hydrant for impacting upon and moving the clamping devices for the hydrant tool servicing the hydrant can be employed.

After the valve is operated, removed or replaced, the wrench 10 can be disassembled for transportation to the next job site.

Although only a limited number of embodiments of applicant's invention has been shown, the scope and breadth of applicant's improved hydrant wrench is to be limited only by the scope and breadth of the annexed claims:

I claim:

1. A portable hydrant wrench for assembly and use to operate and replace valves located within underground portions of hydrants comprising one or more detachable drive bars, detachable heads capable of being affixed to said drive bars for interchangeable mating with the different types of valves employed in the underground portion of the hydrants, a platform positioned within the internal walls of the hydrant proximate to said valves, a plurality of supporting means mounted on said platform for exerting forces against the internal walls of said hydrant to maintain the position of said platform within said hydrant, externally activated power means mounted on said platform, and means for transmitting the output of said power means to said drive bars for moving said drive bars with sufficient torque to rotate said drive bars and said hydrant valves.

2. A portable hydrant wrench as claimed in claim 1 wherein said means for transmitting the output of said power means to said drive bars comprises clamping devices for rectangular drive bars.

3. A portable hydrant wrench as claimed in claim 1 wherein said means for transmitting the output of said power means to said drive bars comprises clamping devices for circular drive bars.

4. A portable hydrant wrench as claimed in claim 1 wherein said means for transmitting the output of said power means to said drive bars comprises clamping devices for elliptical drive bars.

5. A portable hydrant wrench as claimed in claim 1 wherein said means for transmitting the output of said power means to said drive bars comprises clamping devices for triangular drive bars.

6. A portable hydrant wrench as claimed in claim 1 wherein said externally activated power means comprises hydraulic devices.

7. A portable hydrant wrench as claimed in claim 1 wherein said externally activated power means comprises devices employing pneumatic pressures.

8. A portable hydrant wrench as claimed in claim 1 wherein said externally activated power means comprises apparatus employing air as the power transmitting medium.

9. A portable hydrant wrench as claimed in claim 1 wherein said externally activated power means comprises devices employing fluid pressures.

10. A portable hydrant wrench as claimed in claim 1 wherein said externally activated power means comprises apparatus employing oil as the power transmitting medium.

11. A portable hydrant wrench as claimed in claim 1 wherein said platform supporting means comprises spring loaded, telescopic devices.

* * * * *